US011225833B2

(12) United States Patent
Yoo

(10) Patent No.: US 11,225,833 B2
(45) Date of Patent: Jan. 18, 2022

(54) LADDER WITH A GUARDRAIL

(71) Applicant: Thomas Yoo, Garden Grove, CA (US)

(72) Inventor: Thomas Yoo, Garden Grove, CA (US)

( * ) Notice: Subject to any disclaimer, the term of this patent is extended or adjusted under 35 U.S.C. 154(b) by 251 days.

(21) Appl. No.: 16/380,173

(22) Filed: Apr. 10, 2019

(65) Prior Publication Data

US 2020/0325726 A1 Oct. 15, 2020

(51) Int. Cl.
*E06C 7/18* (2006.01)
*E06C 1/393* (2006.01)

(52) U.S. Cl.
CPC ..... *E06C 7/182* (2013.01); *E06C 1/393* (2013.01)

(58) Field of Classification Search
CPC ..... E06C 7/182; E06C 7/181; E06C 7/183; E06C 7/18; E06C 1/393; E06C 1/383
See application file for complete search history.

(56) References Cited

U.S. PATENT DOCUMENTS 2,485,413 A * 10/1949 Ross ..... E06C 7/48 182/214
2,923,373 A * 2/1960 Ledgerwood ..... E06C 7/12 182/102
2,934,163 A * 4/1960 Ladewski ..... E06C 7/48 182/214
3,127,953 A * 4/1964 Shore ..... E06C 1/393 182/106
3,139,155 A * 6/1964 Skeels ..... E06C 7/182 182/106
4,191,397 A * 3/1980 Kassai ..... B62B 7/062 280/647
4,216,974 A * 8/1980 Kassai ..... B62B 7/062 280/42
4,369,860 A * 1/1983 Beane ..... E06C 7/486 182/107
4,643,274 A * 2/1987 Tataseo ..... E06C 7/48 182/106
4,648,481 A * 3/1987 Lee ..... A47C 12/02 182/106
4,824,278 A * 4/1989 Chang ..... E06C 1/32 403/93
5,022,118 A * 6/1991 Wan-Li ..... E06C 1/32 16/327
5,026,198 A * 6/1991 Lin ..... E06C 1/32 16/324
5,113,973 A * 5/1992 Southern ..... E06C 7/48 182/107

(Continued)

*Primary Examiner* — Alvin C Chin-Shue
*Assistant Examiner* — Shiref M Mekhaeil
(74) *Attorney, Agent, or Firm* — John K. Park; Park Law Firm

(57) ABSTRACT

A ladder with a first guardrail locking system having a first pair of side rails with a first set of steps and a second pair of side rails with a second set of steps. The two sets of side rails are rotatably joined together by a pair of hinges at a first pair joining sections and a second pair joining sections. The first pair joining sections and the second pair joining sections have joint points such as indentations which engage the locking key of a first guardrail so that the first guardrail may be fixedly attached to the joining sections.

The ladder may also have a second guardrail, wherein the second guardrail is attached to the first guardrail so that two guardrails form a ring around a user standing on a foldable stand of the ladder.

20 Claims, 16 Drawing Sheets

(56) References Cited

U.S. PATENT DOCUMENTS 5,120,013 A * 6/1992 Sweeney ..... E06C 7/14 182/116
5,121,814 A * 6/1992 Southern ..... E06C 7/48 182/111
5,722,507 A * 3/1998 Kain ..... E06C 1/393 182/104
6,238,125 B1 * 5/2001 Lin ..... B62B 7/06 403/102
6,347,687 B1 * 2/2002 Alim ..... E06C 1/387 182/159
6,651,774 B2 11/2003 Yoo
7,140,072 B2 * 11/2006 Leng ..... E06C 1/32 16/326
7,296,820 B2 * 11/2007 Valdez ..... B62B 7/062 280/647
7,789,199 B2 * 9/2010 Wollenberg ..... E06C 7/48 182/214
8,186,481 B2 * 5/2012 Moss ..... E06C 7/16 182/129
8,251,180 B1 * 8/2012 Paige ..... E06C 7/48 182/107
10,012,000 B2 7/2018 Yoo
D860,476 S * 9/2019 Foley ..... D25/68
D889,689 S * 7/2020 Russell ..... D25/64
2003/0012595 A1 * 1/2003 Park ..... F16C 11/10 403/84
2004/0238278 A1 * 12/2004 Gibson ..... E06C 1/393 182/129
2005/0268434 A1 * 12/2005 Burbrink ..... E06C 1/32 16/324
2006/0102425 A1 * 5/2006 Moldthan ..... E06C 1/387 182/129
2007/0181369 A1 * 8/2007 Gibson ..... E06C 7/14 182/165
2010/0170750 A1 * 7/2010 Leng ..... E06C 7/084 182/219
2011/0011674 A1 * 1/2011 Kim ..... E06C 7/182 182/106
2012/0211305 A1 * 8/2012 Moss ..... E06C 1/22 182/106
2014/0224585 A1 * 8/2014 Russell ..... E06C 7/082 182/116
2015/0308190 A1 * 10/2015 Skubic ..... E06C 1/393 182/124
2017/0226803 A1 * 8/2017 Russell ..... E06C 1/397
2018/0298691 A1 * 10/2018 Cook ..... E06C 7/081
2018/0347278 A1 * 12/2018 Russell ..... E06C 1/387
2019/0078385 A1 * 3/2019 Moss ..... E06C 1/18
2019/0136621 A1 * 5/2019 Zhu ..... E06C 7/50
2019/0145170 A1 * 5/2019 Clark ..... E06C 7/46 182/104
2019/0330920 A1 * 10/2019 Boyer ..... E06C 1/387
2020/0063493 A1 * 2/2020 Yoo ..... E06C 7/182
2020/0141184 A1 * 5/2020 Liu ..... E06C 1/393

* cited by examiner

FIG 8
FIG 9
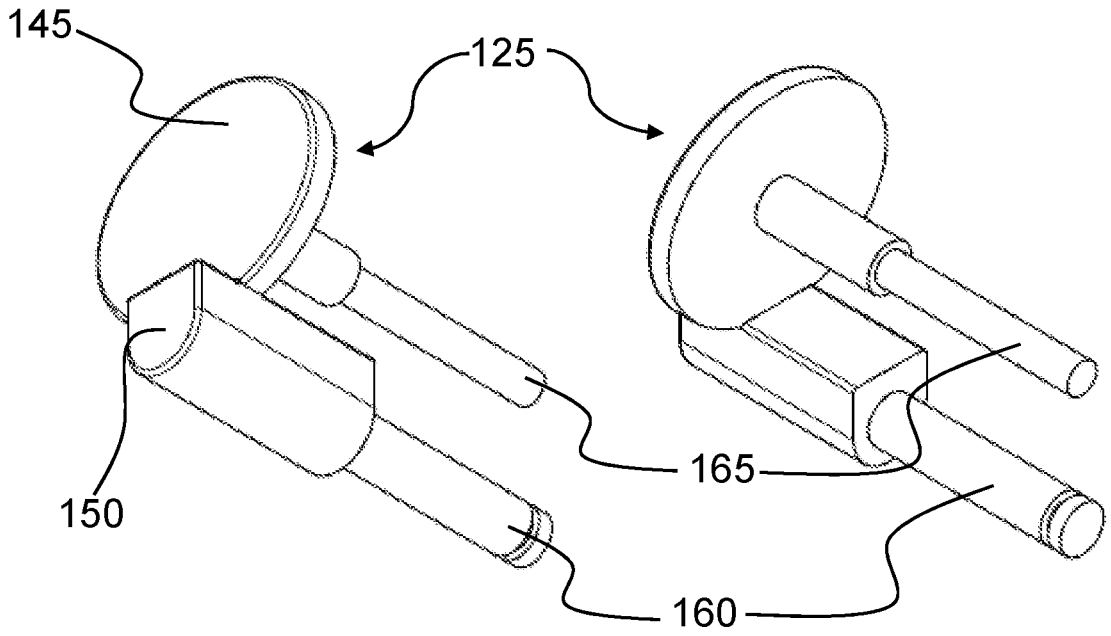
FIG 10
FIG 11
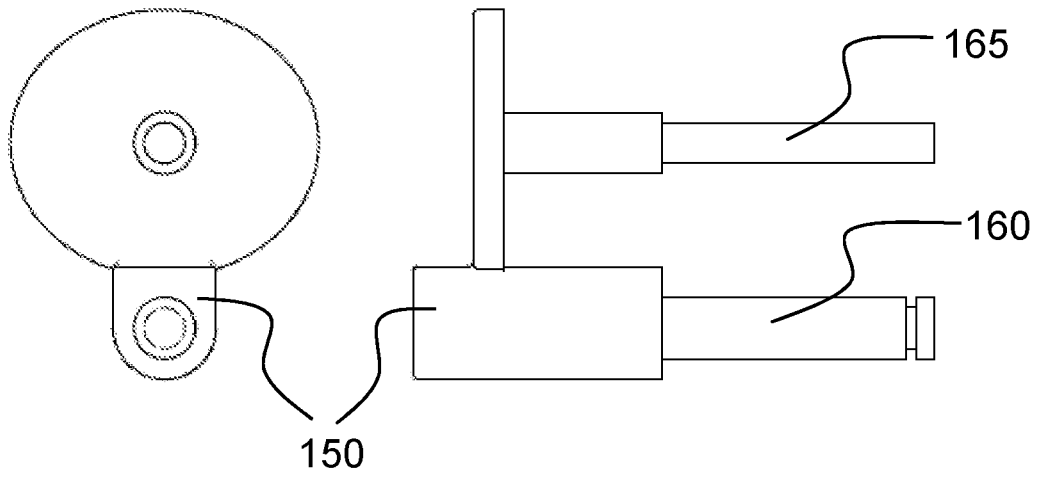

LADDER WITH A GUARDRAIL

BACKGROUND

A need for a ladder with a guardrail locking system has been present for a long time to assist the user in safely using ladders. This invention is directed to solve these problems and satisfy the long-felt need.

SUMMARY

A ladder with one or more guardrails with its locking system is presented herein. The ladder also has a guardrail on or near the top of the ladder may prevent a user from accidently falling off the ladder.

The ladder has a first pair of side rails with a first set of steps located in-between the first pair of side rails and a second pair of side rails with a second set of steps located in-between the second pair of side rails. The first pair of side rails has a first pair joining sections and the second pair of side rails has a second pair joining sections so that the first pair of side rails and the second pair of side rails are rotatably attached with a pair of joining hinges wherein the joining hinges may be using a joining pin, a bolt or other acceptable joining methods at each of the joining hinge.

The first guardrail with a pair of arms are rotatably attached to the first pair joining sections and second pair joining sections by the pair of joining hinges of the ladder. The first pair joining sections comprises of a pair of first rotatable areas and the second pair joining section comprises of a pair of second rotatable areas, and the first pair joining sections further comprises of one or more locking points wherein one or more locking keys attached to the first guardrail engages one or more of the locking points to prevent the first guardrail from rotating freely.

To make the ladder easier to open and close with security, each of the first rotatable areas and second rotatable areas may be flat and round so that the first pair joining sections and second pair joining sections are slidably joined together by the pair of joining pins.

To prevent the latter from arbitrarily open and close, one or more of the locking points are distributed on the edges of the first rotatable area to receive the locking keys of the first guardrail wherein the locking point may be formed by an indentation, slot, depression or protrusion into the edge of the first rotatable area. For a preferred embodiment, the locking keys has a locking protrusion to engage one of the locking points. In addition, the locking key may have a locking button with the locking protrusion located on the first guardrail to slidably move the locking protrusion to engage and disengage one of the locking points. For an improved design, the locking protrusion of the locking key is a protrusion pin that slidably engages and disengages one of the locking points.

The ladder may have a second guardrail attached to the first guardrail so that a user of the ladder can be guarded (or surrounded) by a guardrail all around, providing 360 degrees of guardrail around the person. The second guardrail may be rotatably attached to the pair of arms of the first guardrail. To better protect the user, the second guardrail comprises of a guardrail lock slidably attached to the second guardrail that prevents the second guardrail from freely rotating about the first guardrail.

The guardrail lock has a stopping edge to help prevent the guardrail lock from sliding freely on the second guardrail and overlaps both the corresponding arm of the first guardrail and the corresponding arm of the second guardrail.

Moreover, the guardrail lock may be slidably adjustable so that the guardrail lock can be pushed over, including but not limited to left and right or back and forth motion, to not overlap or cover the corresponding arm of the first guardrail so the guardrail lock does not engage the arm of the first guardrail. Furthermore, the guardrail lock may be adjustable by having a slider that may be used to push the guardrail lock sideways.

The ladder further comprises of a foldable stand attached to one of the steps of the first pair of side rails and attached to one of the steps of the second pair of side rails, wherein the foldable stand may be folded or bent at about the middle of the stand.

The advantages of the embodiments of the ladder described herein, including but not limited, are: (1) helps the user of the ladder to more securely stand on the stand guarded by the first guardrail on one side, (2) helps the user of the ladder to more securely stand on the stand guarded by the first guardrail on two opposite sides, (3) helps the user of the ladder to more securely stand on the stand guarded by the first guardrail on all sides, (4) securely lock the guardrails so the guardrails do not freely move about while the user is working on the ladder, (5) the user may adjust the first guardrail and the second guardrail while standing on the ladder, and (6) the ladder and the guardrails can easily folded for storage.

Although the present invention is briefly summarized, a better understanding of the invention can be obtained by the following drawings, detailed description and appended claims.

DESCRIPTION OF THE DRAWINGS

These and other features, aspects and advantages of the present invention will become better understood with reference to the accompanying drawings, wherein:

FIG. 8 is a view of the locking key;

FIG. 9 is another view of the locking key;

FIG. 10 is another view of the locking key;

FIG. 11 is another view of the locking key;

DETAILED DESCRIPTION

Referring to the figures, various embodiments of the invention are described.

Figure 1:
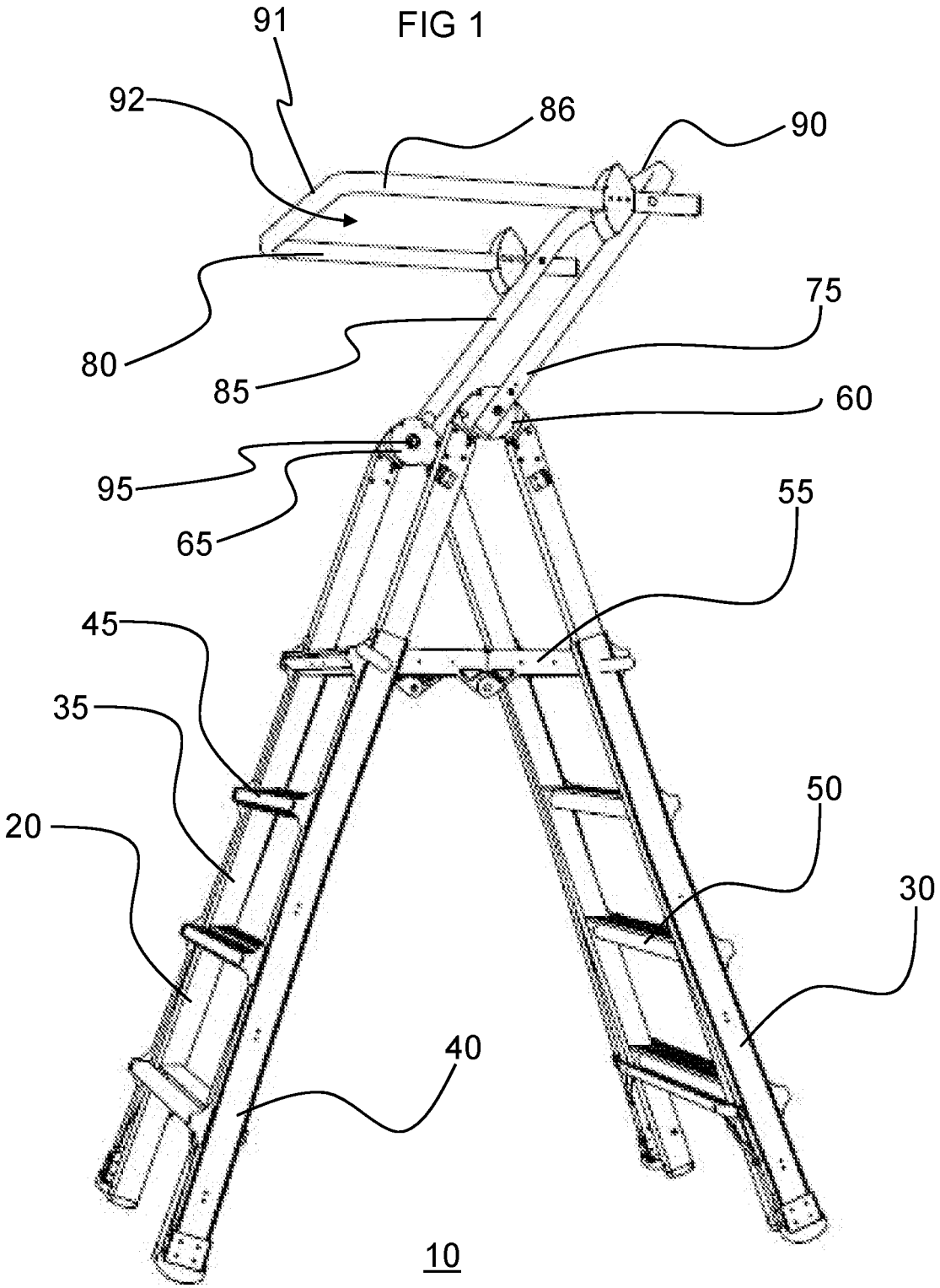
FIG. 1 is an embodiment of the ladder showing the first guardrail and the second guardrail.

FIG. 1 shows an embodiment of a ladder 10 described herein. The ladder 10 has a first pair of side rails 20 and a second pair of side rails 30. The first pair of side rails 20 are comprised of a left rail 35 of the first pair of side rails 20 and a right rail 40 of the first pair of side rails 20, and the first pair of side rails 20 has a first set of steps 45 in-between the first pair of side rails 20. Likewise, the second pair of side rails 30 are comprised of a left rail 35 of the second pair of side rails 30 and a right rail 40 of the second pair of side rails 30, and the second pair of side rails 30 has a second set of steps 50 in-between the second pair of side rails 30.

The ladder 10 further comprises of a foldable stand 55 attached to one of the steps of the first pair of side rails and to one of the steps of the second pair of side rails so that the foldable stand 55 may be folded to be stowed away.

The ladder 10 further comprises of a first pair of joining sections 60 and a second pair of joining sections 65 wherein the first pair of side rails 20 and the second pair of side rails 30 are rotatably attached with a pair of joining hinges 95.

The ladder 10 further comprises of a first guardrail 75 and a second guardrail 80. The first guardrail 75 is attached to the first pair of joining sections 60 and attached to the second pair of joining sections 65. The first guardrail 75 has a pair of first-guardrail arms (or arms) 85 wherein each of the pair of first-guardrail arms 85 of the first guardrail 75 is attached to the first pair of joining sections 60 and the second pair of joining sections 65, respectively. The pair of first-guardrail arms 85 are joined together by a first bar 90.

Figure 30:
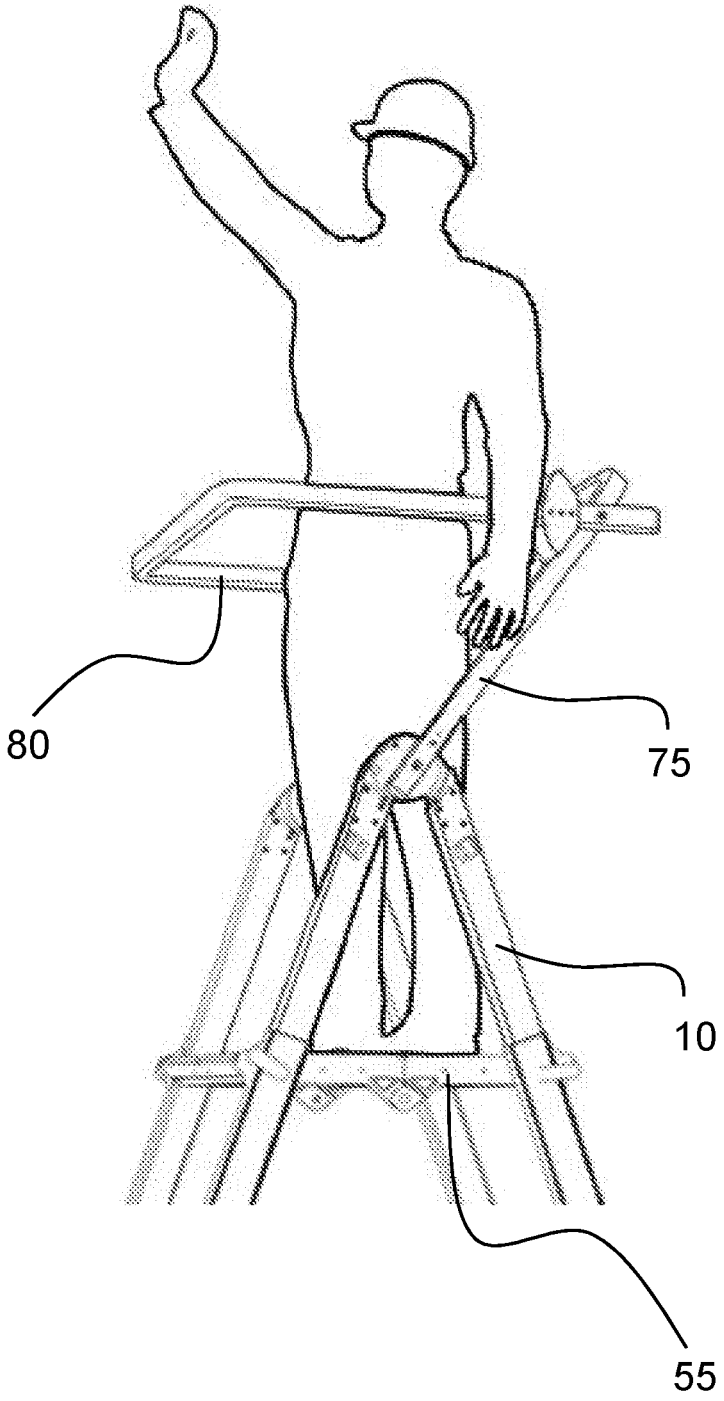
FIG. 30 is a view of a user using the ladder with both the first guardrail and the second guardrail.

The second guardrail 80 is attached to the first guardrail 75. The second guardrail 80 has a pair of second-guardrail arms 86 wherein each of the pair of second-guardrail arms 86 is attached to the first guardrail 75 at the respective first-guardrail arms 85. The pair of the second-guardrail arms 85 are joined together by a second bar 91. Each of the second-guardrail arms 86 is attached on the respective first-guardrail arms 85, away from the joining hinges 95 and towards the first bar 90. As shown in FIG. 1, the first guardrail and the second guardrail form a loop 92 wherein a user may stand in it, as shown in FIG. 30.

Figure 2:
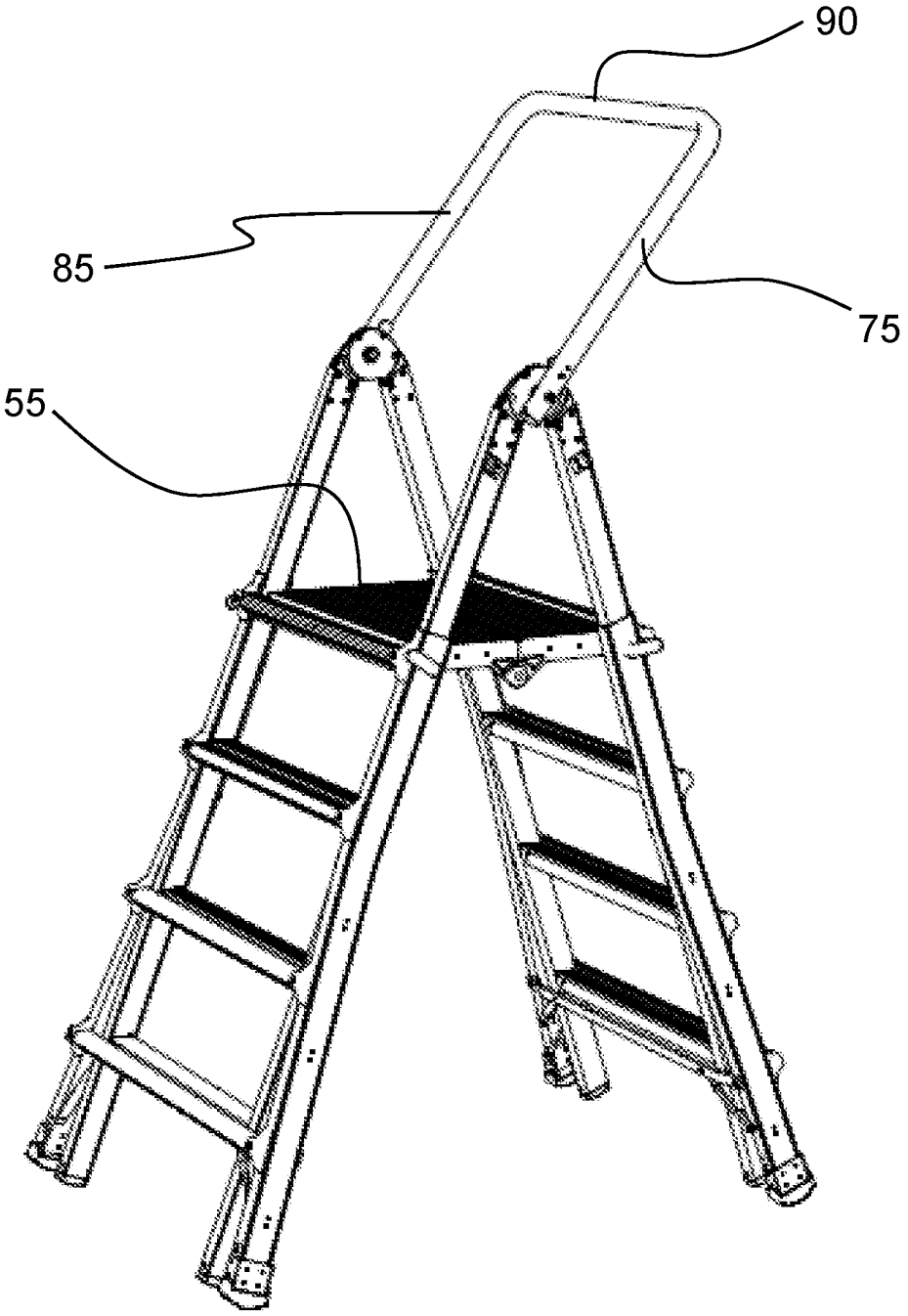
FIG. 2 is an embodiment of the ladder showing the first guardrail.

FIG. 2 shows an embodiment of the ladder showing the first guardrail 75. The difference between the ladder shown in FIG. 1 and FIG. 2 is that the ladder shown in FIG. 2 does not have the second guardrail 80. The first guardrail 75 comprises of a pair of arms 85 of the first guardrail 75 and the first bar 90 of the first guardrail 75 connecting the pair of arms 85 of the first guardrail 75. This embodiment does not have the second guardrail 80 shown in FIG. 1.

Figure 3:
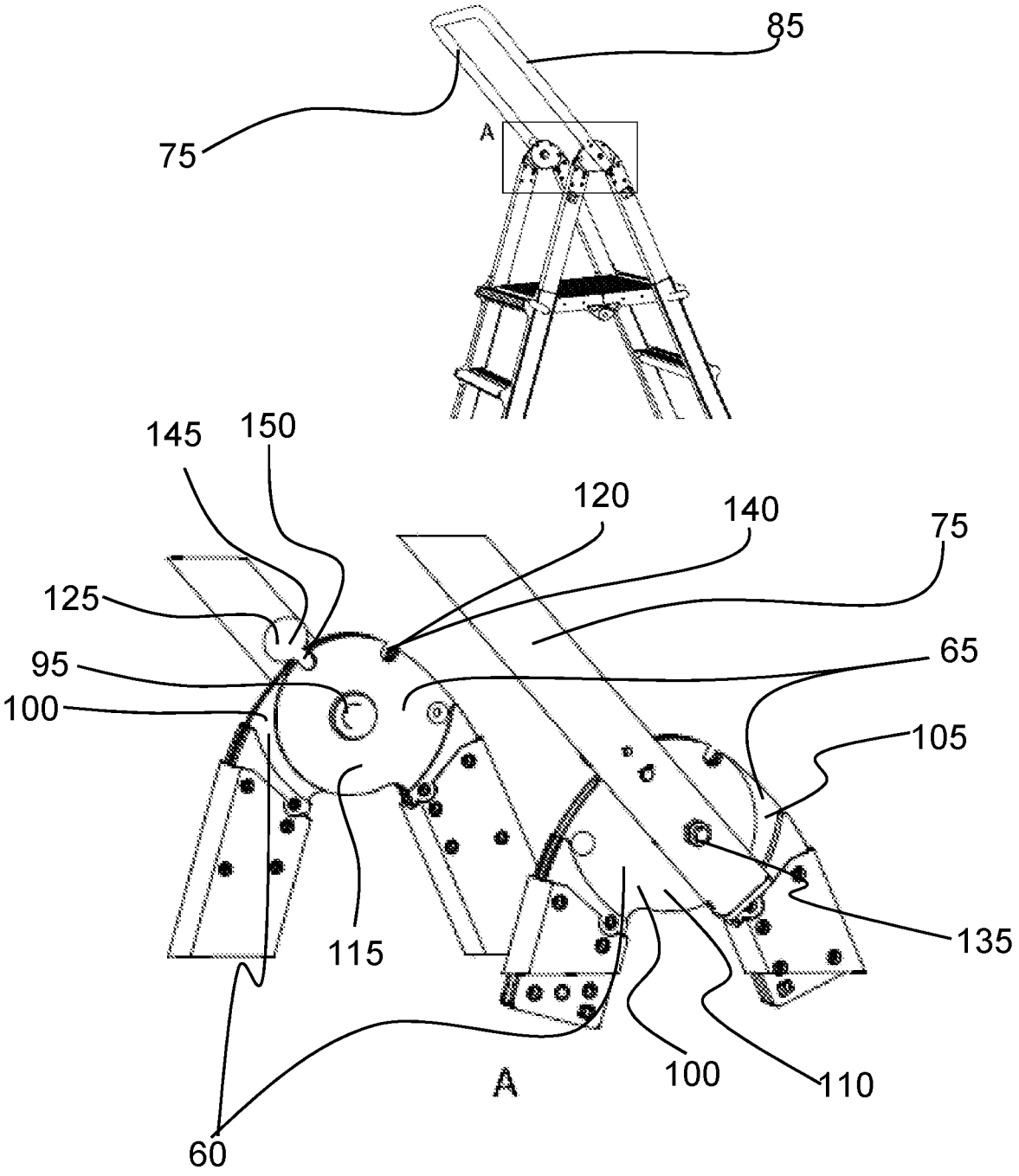
FIG. 3 is a view of the first pair joining sections and second pair joining sections joined by joining hinges.

FIG. 3 is a view of the first pair joining sections 60 and second pair joining sections 65 joined by joining hinges 95. The first pair joining sections comprise two first joining sections 100 and the second pair joining sections comprise two second joining sections 105. The first pair joining sections 60 are located at upper ends of the first pair of side rails 20 and the second pair joining sections 65 are located at upper ends of the second pair of side rails 30.

The first pair joining sections 60 comprises of a pair of first rotatable areas 110 and the second pair joining section 65 comprises of a pair of second rotatable areas 115. The first pair joining sections 60 further comprises of one or more locking points 120 distributed on an edge of the first rotatable area 110, wherein one or more locking keys 125 attached to the first guardrail 75 engages one or more of the locking points 120 to prevent the first guardrail 75 from rotating freely. The second pair joining sections 65 also comprises of one or more locking points 120 distributed on an edge of the second rotatable area 115, wherein one or more locking keys 125 attached to the first guardrail 75 engages one or more of the locking points 120 to prevent the first guardrail 75 from rotating freely.

The first pair joining sections 60 and the second pair joining sections 65 are rotatably held together by joining hinges 95. The hinges may be joining pins 135, joining bolts or other mechanical devices to rotatably hold two moving parts together. The locking points 120 may also be indentations 140 placed on the first rotatable area 110 or on the second rotatable area 115 or both. Moreover, the locking keys may comprise of a locking button 145 with the locking protrusion 150, wherein the locking button 145 is located on the first guardrail 75 to slidably move the locking protrusion 150 to engage and disengage one of the locking points 120.

Figure 4:
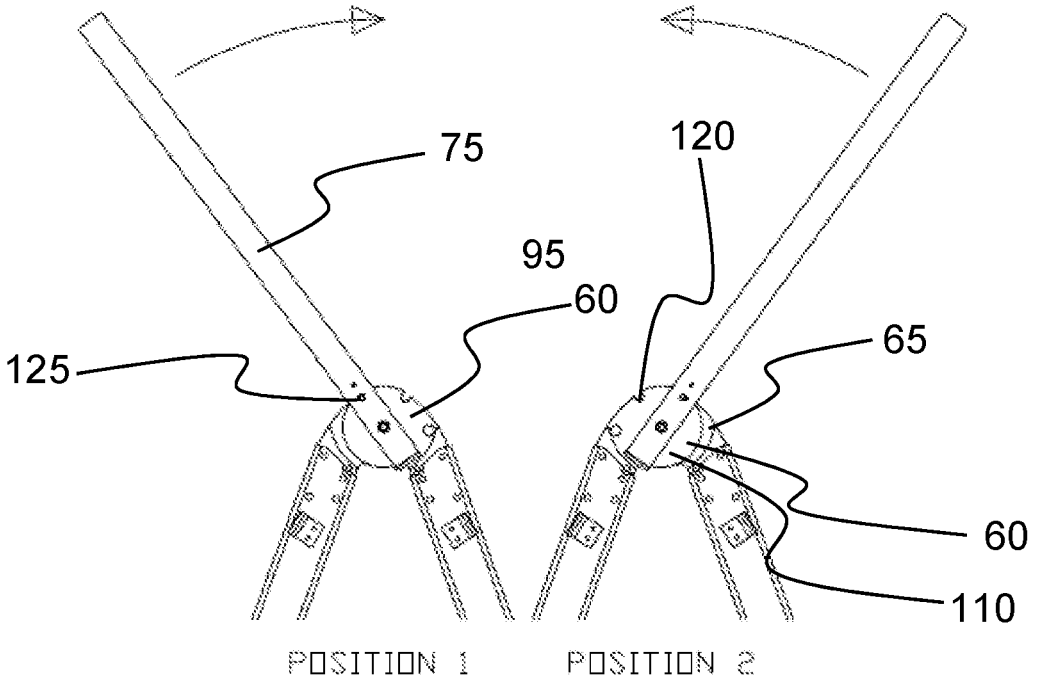
FIG. 4 is a view of the first guardrail showing its adjustability.
Figure 5:
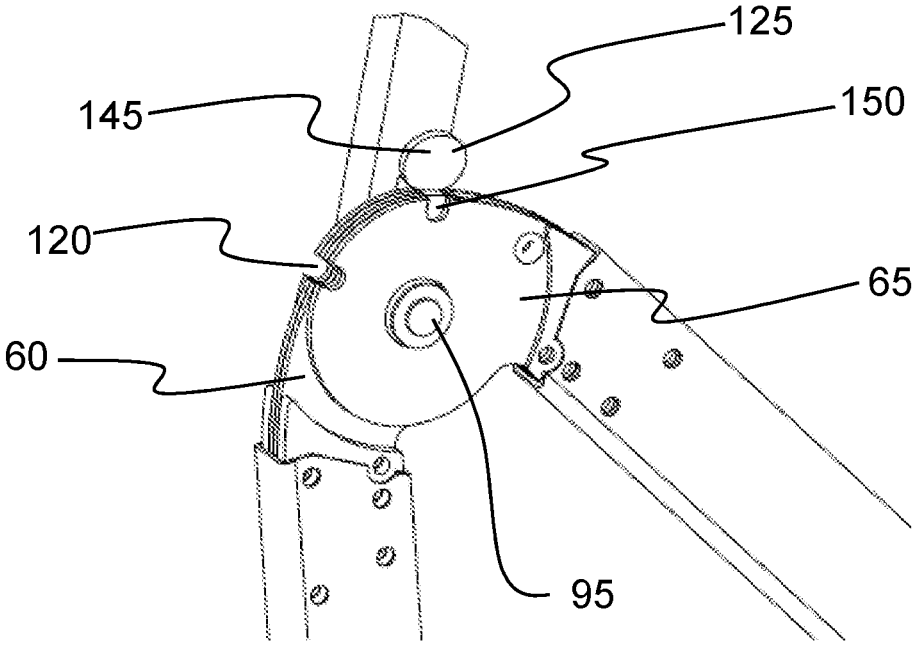
FIG. 5 is a view of the joining sections showing the locking key.
Figure 6:
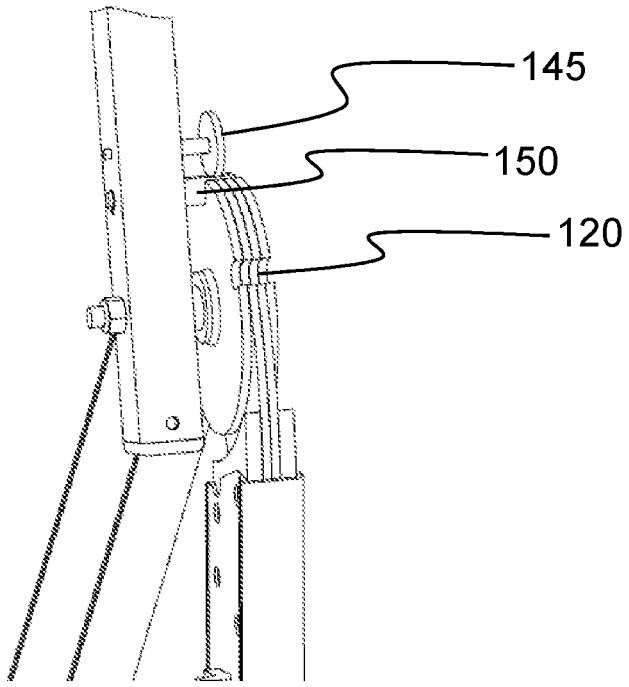
FIG. 6 is another view of the joining sections showing the locking key.
Figure 7:
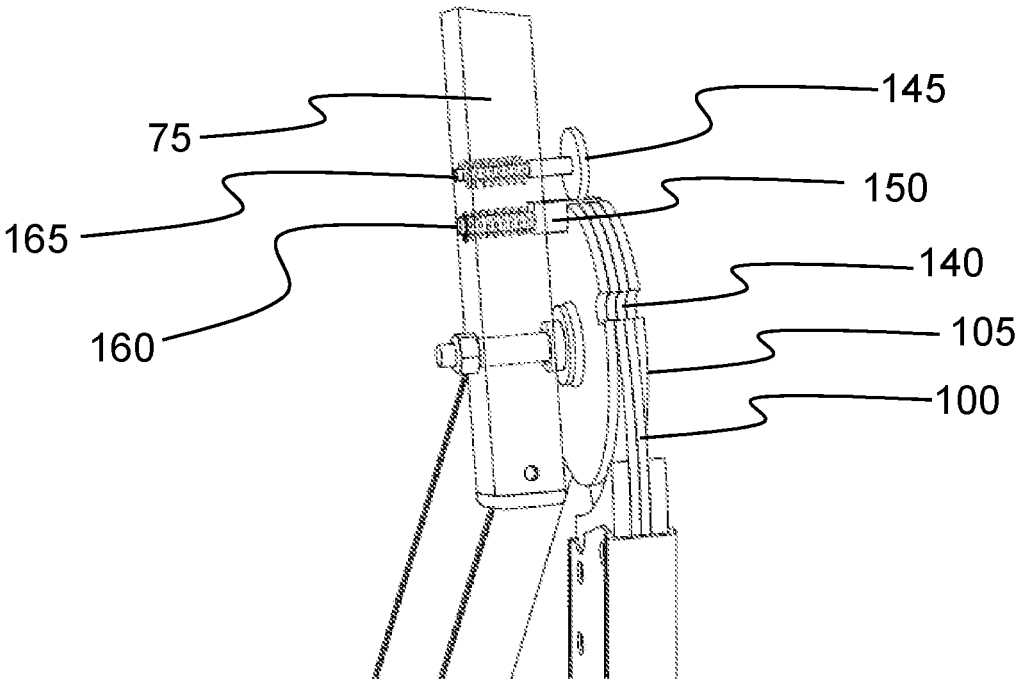
FIG. 7 is another view of the joining sections showing the locking key.
Figure 12:
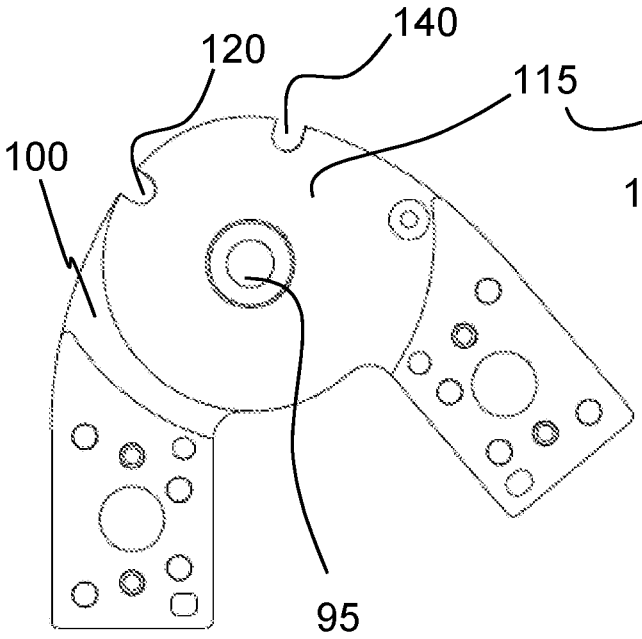
FIG. 12 is a view of the joining sections joined by a joining hinge.

FIGS. 4 and 5 show the adjustability of the first guardrail 75 rotatably attached to the first pair of joining sections 60. FIG. 4 also shows the first guardrail 75 rotatably attached to the second pair of joining sections 65. FIG. 5 illustrates the first guardrail 75 may be rotatably moved around a joining hinge 95 and securely locked into position by a locking key 125 engaging a locking point 120 on one of the first pair of joining sections 60. The locking key 125 also has a locking button 145 with the locking protrusion 150, wherein the locking button 145 is located on the first guardrail 75 to slidably move the locking protrusion 150 to engage and disengage one of the locking points 120.

FIGS. 6-11 show the joining sections showing the locking key 125. The locking key 125 comprises of the locking button 145 and the locking protrusion 150 with its protrusion pin 160 to slidably engage and disengage one of the locking points 120. The locking key 125 also has a key pin 165 that allows the locking key to slide in and out of the first guardrail 75 so the locking protrusion 150 may engage and disengage the locking points 120. The key pin 165 and the protrusion pin 160 may be spring loaded to facilitate the return of the key pin 165 and the protrusion pin 160 to predetermined positions when not pressed.

FIGS. 12-15 show the details of the first joining section 100 of the first pair joining sections 60 and the second joining section 105 of the second pair joining sections 65 joined by a joining hinge 95. The first joining section 100 has the first rotatable area 110 (underneath the second rotatable area 115, thus not shown fully) and the second joint section 105 has the second rotatable area 115. Each of the first rotatable areas 110 and second rotatable areas 115 is flat and round shaped so that the first pair joining sections 60 and second pair joining sections 65 are slidably joined together by the pair of joining pins 135 at the first rotatable area 110 and the second rotatable area 115.

One or more of the locking points 120 are distributed on the edges of the first rotatable area 110 and on the edges of the second rotatable area 115 to receive one of the locking keys 125 of the first guardrail 75.

Figure 13:
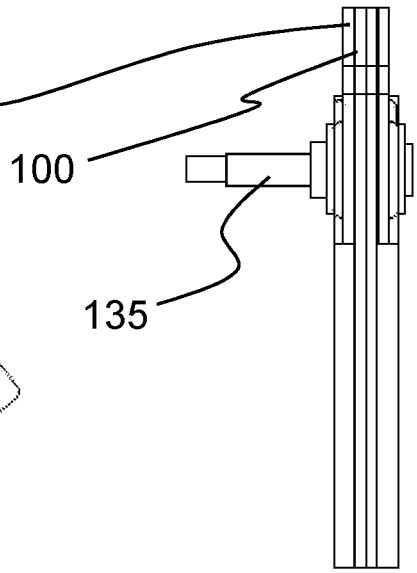
FIG. 13 is a side view of the joining sections joined by a joining hinge.
Figure 14:
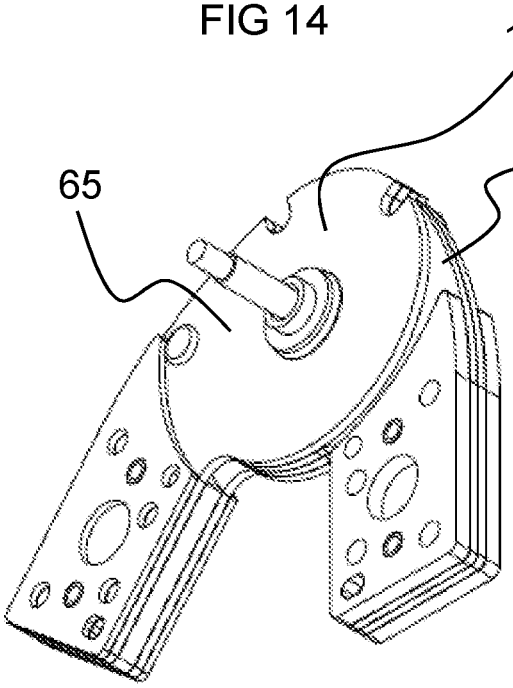
FIG. 14 is another view of the joining sections joined by a joining hinge.
Figure 15:
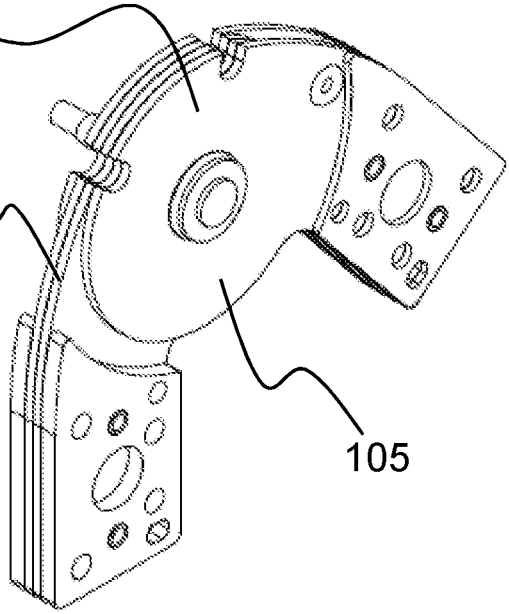
FIG. 15 is another view of the joining sections joined by a joining hinge.
Figure 16:
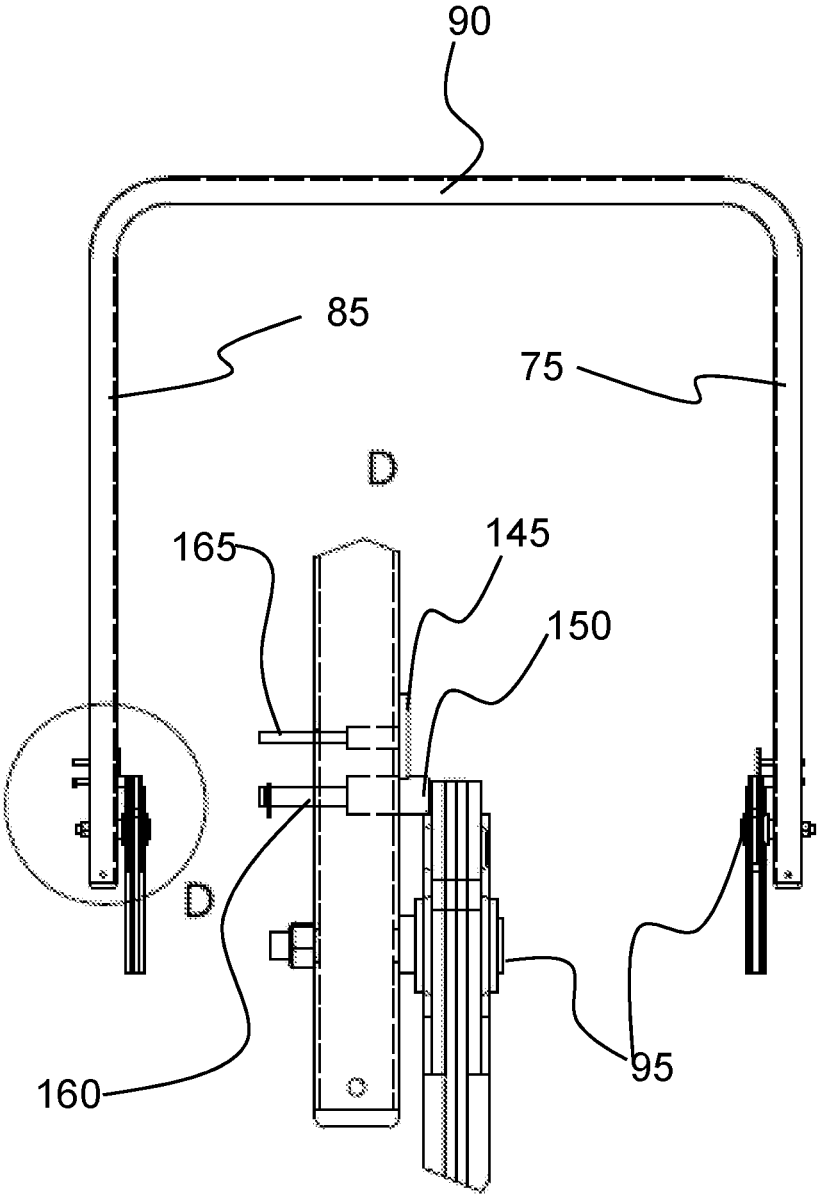
FIG. 16 is a view of the first guardrail attached to the joining section.
Figure 17:
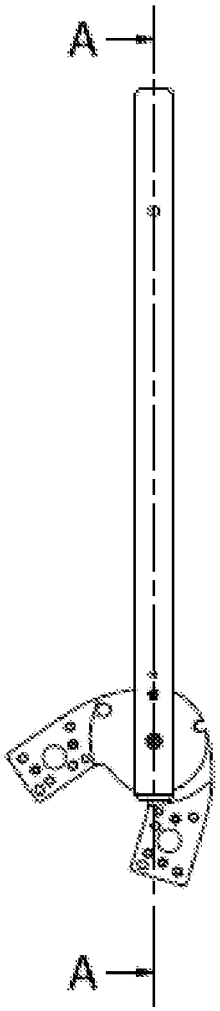
FIG. 17 is another view of the first guardrail attached to the joining section.

FIG. 13 shows a side view of one example of one of the first pair of joining sections 60 and one of the second pair of the joining sections 65 joined together at the first rotatable area 110 and the second rotatable area 115 using the joining hinge 95 wherein the joining hinge 95 connects through both the first rotatable area 110 and the second rotatable area 115 using a joining pin 135. One of the first pair of joining sections 60 and one of the second pair of the joining sections 65 shown in FIG. 13 are comprised of two first joining sections 100 and two second joining sections 105 wherein the two first joining sections 100 (with their first rotatable areas 110) are sandwiched between two second joining sections 105 (with their second rotatable areas 115). FIGS. 14 and 15 are two views, left and right, of FIG. 13.

Figure 18:
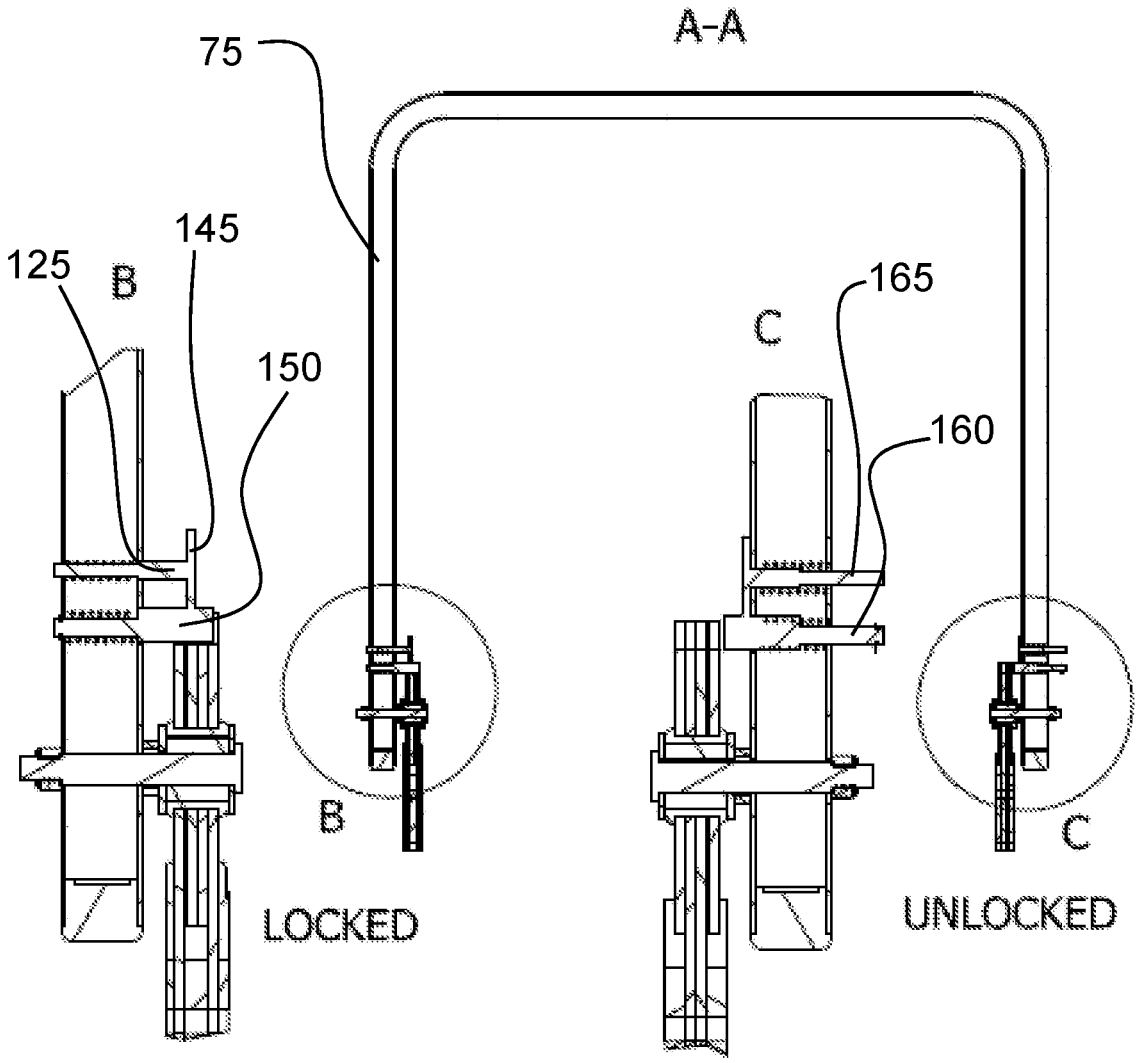
FIG. 18 is another view of the first guardrail attached to the joining section.

FIGS. 16-19 show the working of the locking key 125. The locking key 125 has the key pin 165, the locking button 145 and the protrusion 150 and the protrusion pin 160. The locking key 125 is installed on the first guardrail 75 with both the key pin 165 and the protrusion pin 160 slidably placed in an arm 85 of the first guardrail 75. As earlier shown in FIGS. 6 and 7, springs may be placed on the key pin 165 and the protrusion pin 160 to automatically push the key pin 165 and the protrusion pin 160 so that the protrusion pin 160 engages the indentations 140 of the first rotatable area 110 and of the second rotatable area 115 for securely locking the first guardrail 75 from freely rotating about the joining hinge 95. FIG. 18 shows both the locked position and the unlocked position of the first guardrail 75. The locked position has the locking protrusion 150 engaging the indentations 140 of the first rotatable area 110 and of the second rotatable area 115, but the unlocked position has the locking protrusion 150 disengaged from the indentations 140 of the first rotatable area 110 and of the second rotatable area 115.

Figure 19:
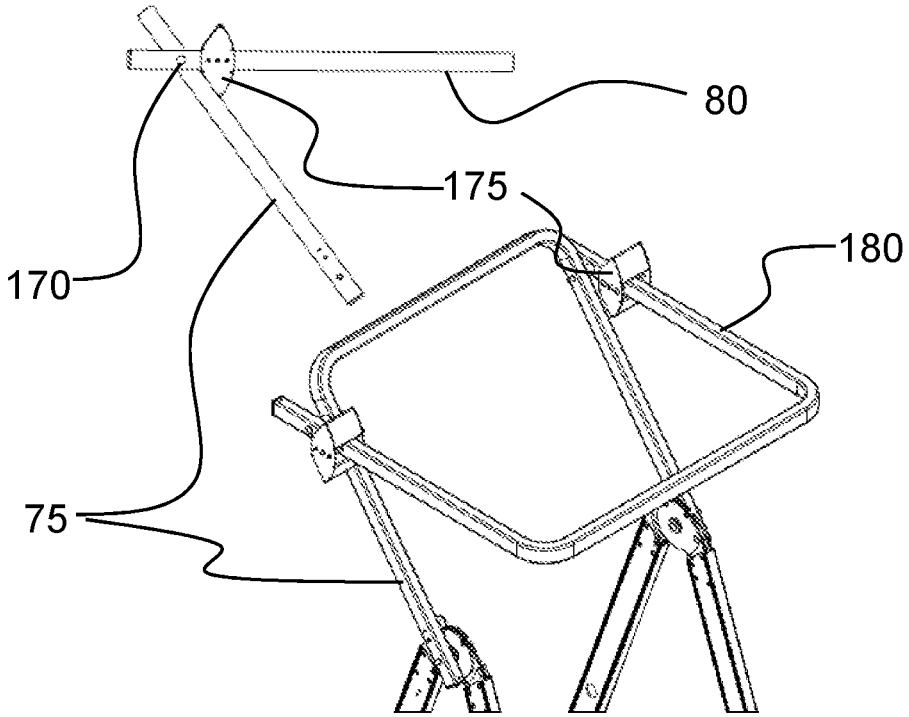
FIG. 19 is a view of the second guardrail attached to the first guardrail of the ladder.
Figure 20:
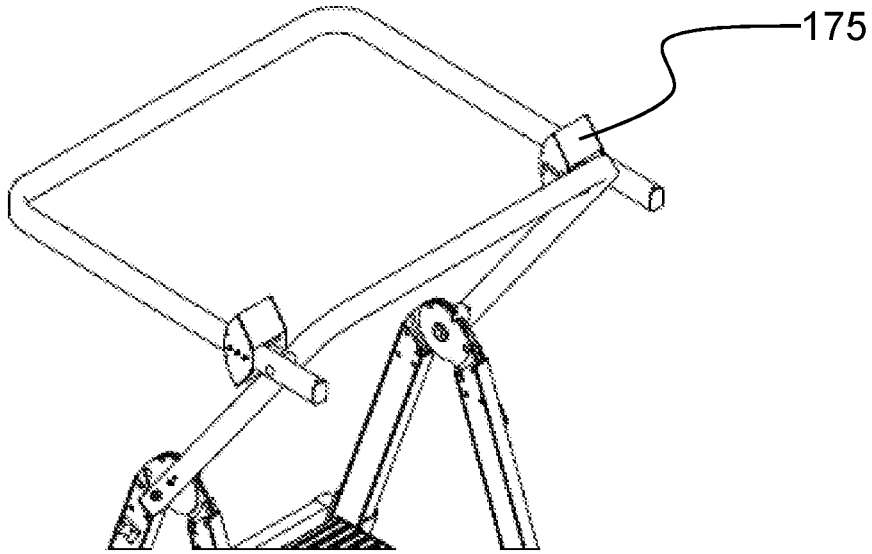
FIG. 20 is another view of the second guardrail attached to the first guardrail of the ladder.

FIGS. 19 and 20 show a second guardrail 80 rotatably attached to the first guardrail 75 at the guardrail mount 170. A guardrail lock 175 is slidably attached to a second guardrail arm 180 or the guardrail lock may be fixedly attached to the second guardrail arm 180.

Figure 21:
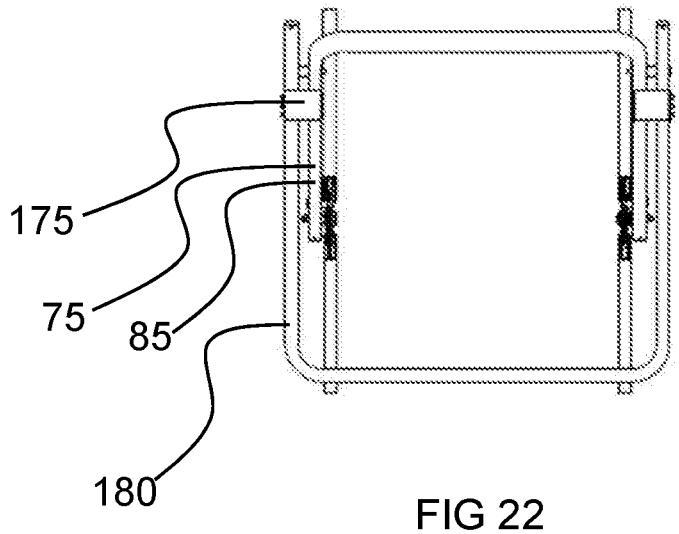
FIG. 21 is a view of the second guardrail attached to the first guardrail of the ladder showing the use of the guardrail lock.
Figure 22:
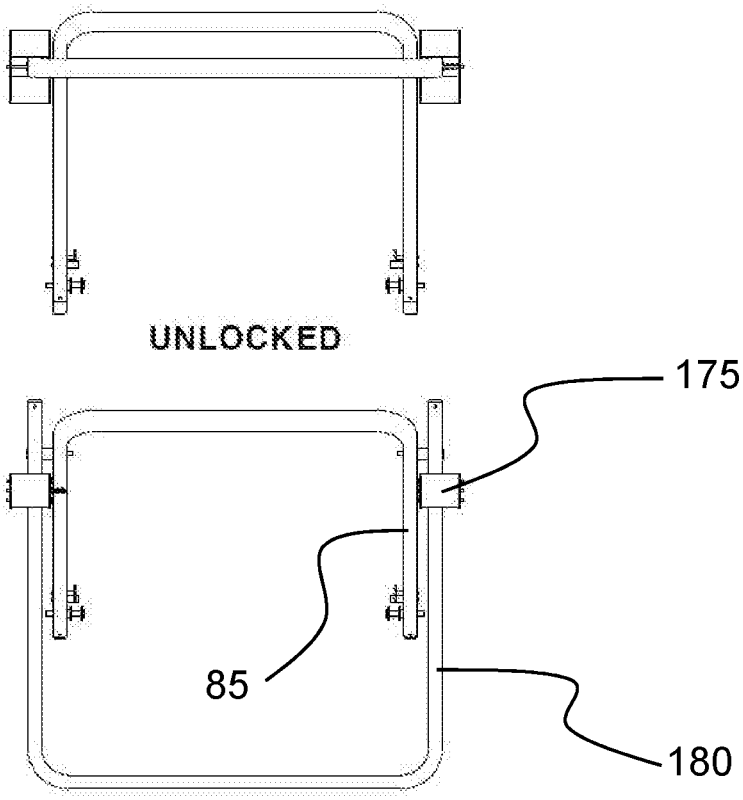
FIG. 22 is another view of the second guardrail attached to the first guardrail of the ladder showing the use of the guardrail lock.

FIG. 21 shows the guardrail lock 175 overlapping both the corresponding arm 85 of the first guardrail 75 and the corresponding arm (the second guardrail arm) 180 of the second guardrail 80 to prevent the second guardrail 80 from freely rotating about the guardrail mount 170. FIG. 22 shows the guardrail lock 175 is slidably adjustable about the second guardrail arm 180 so that the guardrail lock 175 may be pushed over to not overlap the corresponding arm 85 of the first guardrail 75 so that the guardrail lock 175 does not engage the arm of the first guardrail 85.

Figure 23:
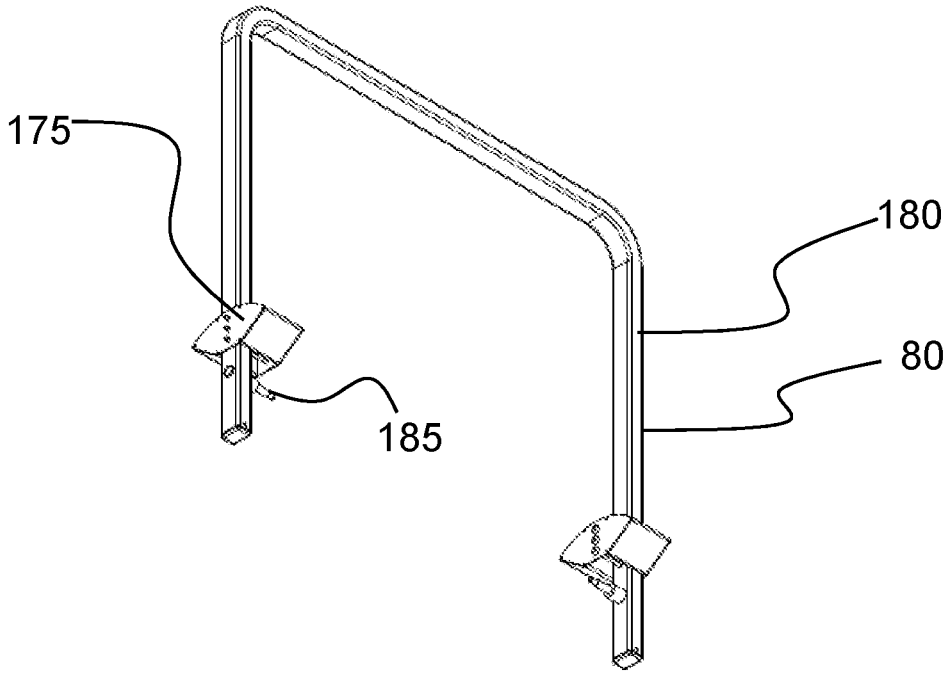
FIG. 23 is a view of the guardrail lock.

FIG. 23 shows the guardrail lock 175 fixedly attached to the arm of the second guardrail (the second guardrail arm) 180. As an alternate design, the guardrail lock 175 may be slidably attached to the arm of the second guardrail (the second guardrail arm) 180 such that the guardrail lock 175 may slide up and down the length of the arm of the second guardrail (the second guardrail arm) 180. FIG. 23 also shows that the guardrail mount may comprise of a guardrail mount pin 185.

Figure 24:
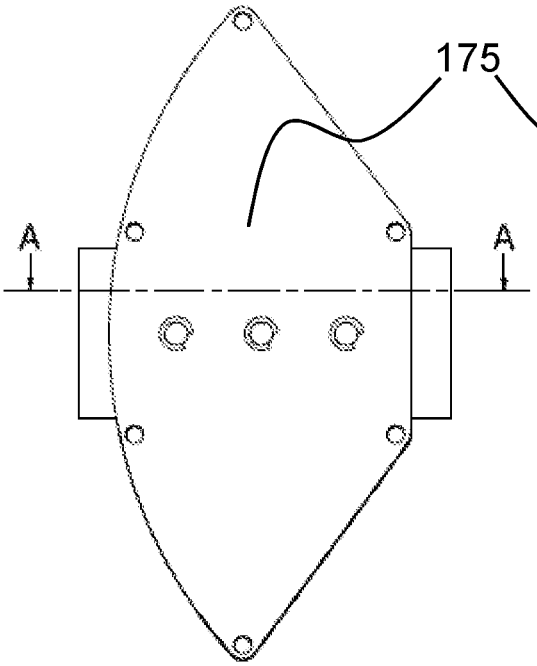
FIG. 24 is another view of the guardrail lock.
Figure 25:
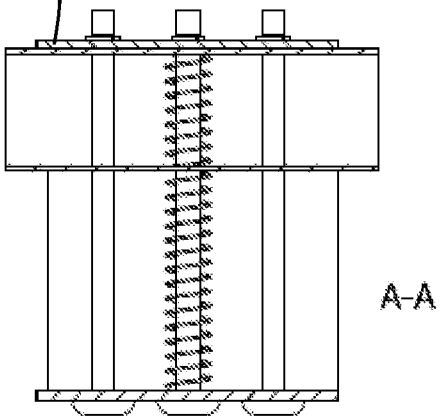
FIG. 25 is a view of an example of the mechanics of the guardrail lock.
Figure 26:
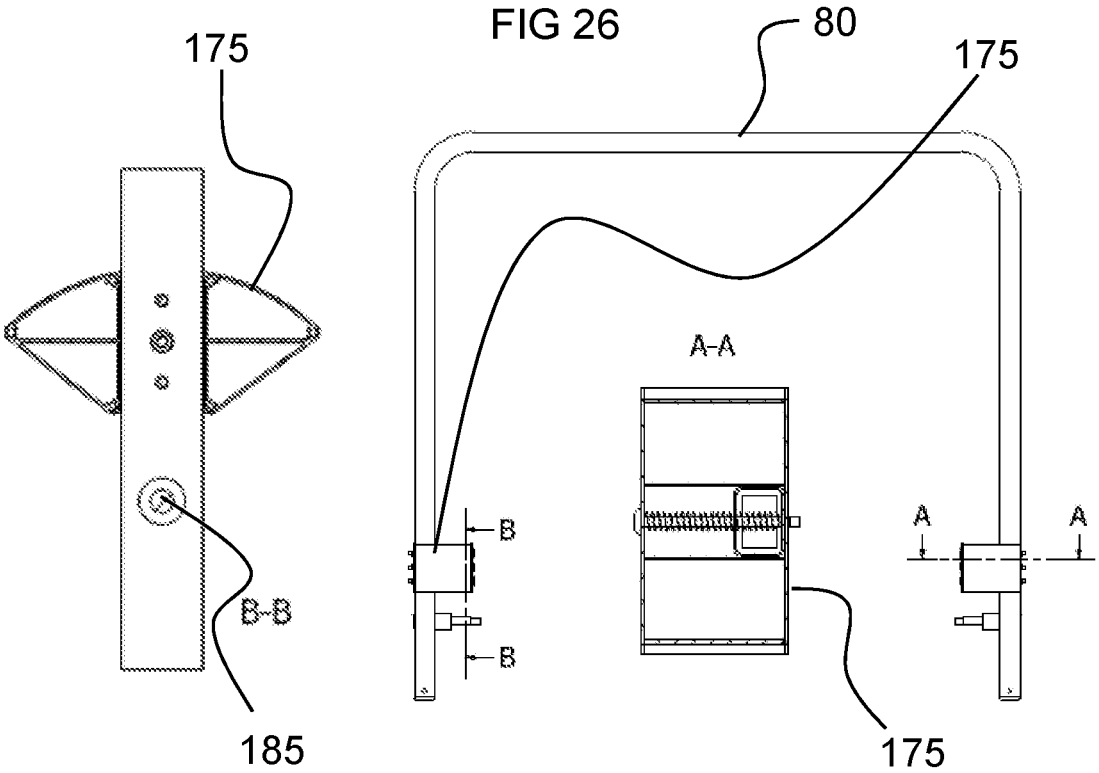
FIG. 26 is a view of an example of the working of the guardrail lock.

FIGS. 24-27 show more details about the guardrail lock 175. View A-A of FIG. 24 shows that the guardrail lock 175 is also spring loaded so that the guardrail lock may overlap both the corresponding arm 85 of the first guardrail 75 and the corresponding arm (the second guardrail arm) 180 of the second guardrail 80 when the spring is not depressed, and the guardrail lock 175 does not overlap both the corresponding arm 85 of the first guardrail 75 and the corresponding arm (the second guardrail arm) 180 of the second guardrail 80 when the spring is depressed to freely rotate the second guardrail 80 about the first guardrail 75.

Figure 27:
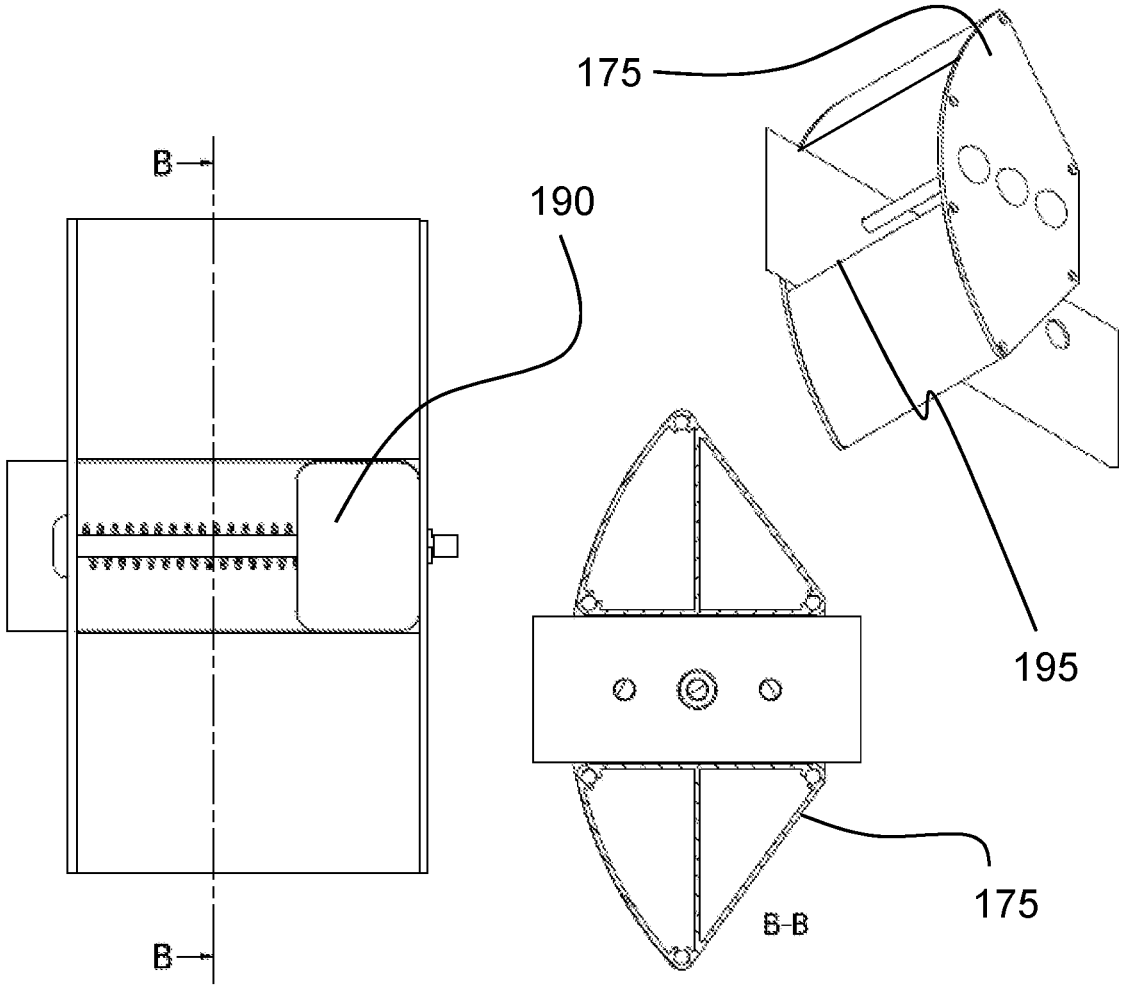
FIG. 27 is another view of the guardrail lock.

FIG. 27 shows the guardrail lock is adjustable by having a slider 190 that may be used to push the guardrail lock 175 sideways to have the guardrail lock 175 cover over the first guardrail 75 or disengage the first guardrail 75. FIG. 27 also shows that the guardrail lock 175 has a stopping edge 195 to help prevent the guardrail lock 175 from sliding about freely on the second guardrail 80 when the guardrail lock 175 is not fixedly attached to the second guardrail 80.

Figure 28:
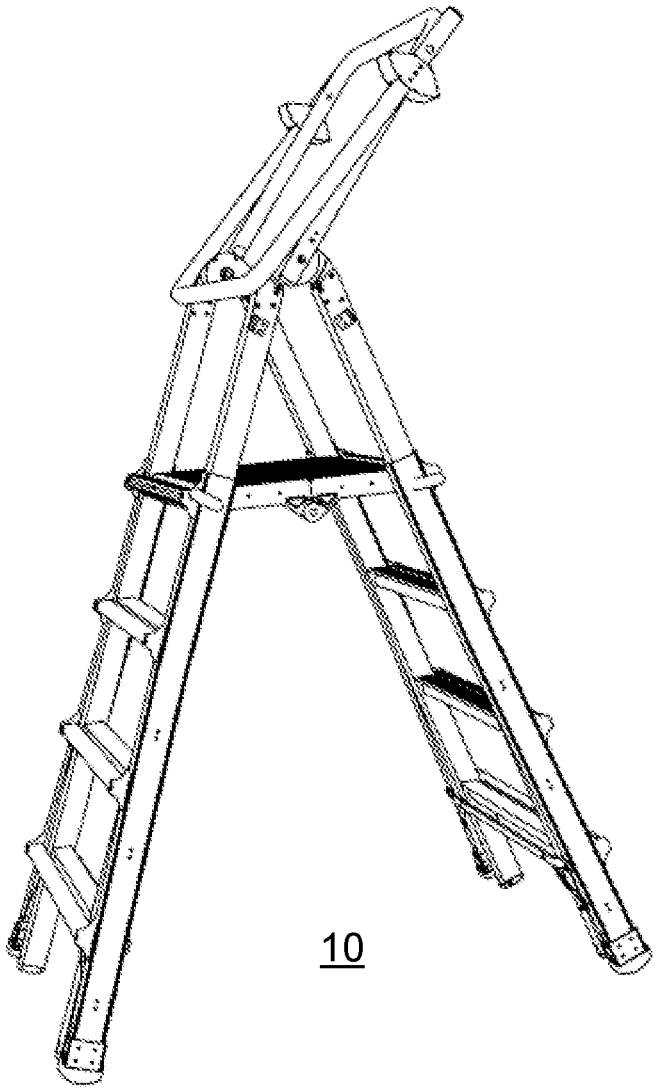
FIG. 28 is a view of the ladder with the second guardrail folded.
Figure 29:
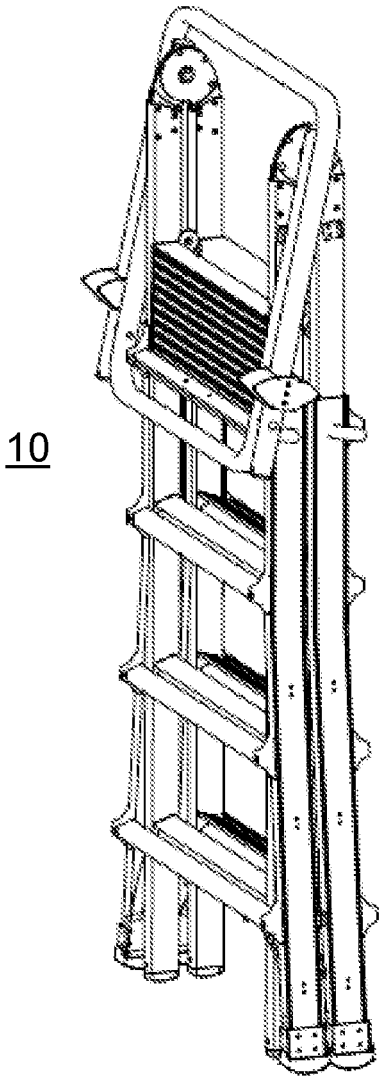
FIG. 29 is a view of the ladder folded for storage.

FIG. 28 shows the ladder 10 with the second guardrail 80 folded and FIG. 29 shows the ladder 10 folded for storage. FIG. 30 shows a user standing on the foldable stand 55 of the ladder 10 with both the first guardrail 75 and the second guardrail 80.

While various embodiments have been shown and described, it will be appreciated by those skilled in the art that variations in form, detail, compositions and operation may be made without departing from the spirit and scope of the invention. Thus, the specification and the embodiments presented herein do not limit the scope of the invention, but only illustrate the best mode at the time of this application and possible potentials of the invention. Therefore, the claims presented shall be interpreted to the full scope afforded by law.

What is claimed is:

1. A ladder with a first guardrail locking system, said ladder comprising:

a first pair of side rails comprising a first set of steps in-between the first pair of side rails and further comprising a first pair joining sections;

a second pair of side rails comprising a second set of steps in-between the second pair of side rails and further comprising a second pair joining sections, wherein the first pair of side rails and the second pair of side rails are rotatably attached with a pair of joining hinges;

a first guardrail with a pair of first-guardrail arms wherein the pair of first guardrail arms are rotatably attached to the first pair joining sections and second pair joining sections by the pair of joining hinges, wherein the pair of first guardrail arms are joined together by a first bar;

A second guardrail is attached to the first guardrail, wherein the second guardrail has a pair of second-guardrail arms wherein each of the pair of second guardrail arms is attached to the first guardrail at the respective first guardrail arms, wherein the pair of the second guardrail arms are joined together by a second bar, and each of the second-guardrail arms is attached on the respective first-guardrail arms, away from the joining hinges and towards the first bar, and wherein the first guardrail and the second guardrail form a loop;

wherein the first pair joining sections comprises of a pair of first rotatable areas and the second pair joining section comprises of a pair of second rotatable areas, and the first pair joining sections further comprises of one or more locking points wherein one or more locking keys attached to the first guard rail engages one or more of the locking points to prevent the first guardrail from rotating freely, wherein one or more of the locking points are distributed on an edge of a first rotatable area to receive one of the locking keys of the first guardrail.

2. The ladder of claim 1 wherein the joining hinges are a pair of joining pins.

3. The ladder of claim 2 wherein each of the first rotatable areas and second rotatable areas is flat and round so that the first pair joining sections and second pair joining sections are slidably joined together by the pair of joining pins.

4. The ladder of claim 3 wherein one or more of the locking points are distributed on edges of the second rotatable area to receive one of the locking keys of the first guard rail.

5. The ladder of claim 4 wherein at least one locking point is formed by an indentation into the edge of the first rotatable area.

6. The ladder of claim 5 wherein at least one of the locking keys has a locking protrusion to engage one of the locking points.

7. The ladder of claim 6 wherein the locking key comprises of a locking button with the locking protrusion, wherein the locking button is located on the first guardrail to slidably move the locking protrusion to engage and disengage one of the locking points.

8. The ladder of claim 7 wherein the locking protrusion comprises of a protrusion pin to slidably engage and disengage one of the locking points.

9. The ladder of claim 1 wherein the second guardrail is rotatably attached to the pair of first guardrail arms of the first guardrail.

10. The ladder of claim 9 wherein the second guardrail comprises of a guardrail lock that prevents the second guardrail from freely rotating about the first guardrail.

11. The ladder of claim 10 wherein the guardrail lock is slidably attached to the second guardrail.

12. The ladder of claim 11 wherein the guardrail lock has a stopping edge to help prevent the guardrail lock from sliding freely on the second guardrail.

13. The ladder of claim 12 wherein the guardrail lock overlaps both the corresponding first guardrail arm of the first guardrail and a corresponding second guardrail arm of the second guardrail.

14. The ladder of claim 13 wherein the guardrail lock is slidably adjustable so that the guardrail lock may be pushed over to not overlap the corresponding first guardrail arm of the first guardrail so the guardrail lock does not engage the first guardrail arm of the first guardrail.

15. The ladder of claim 14 wherein the guardrail lock is adjustable by having a slider that may be used to push the guardrail lock sideways.

16. The ladder of claim 15 wherein the ladder further comprises of a foldable stand attached to one of the steps of the first pair of side rails.

17. A ladder with a first guardrail locking system, said ladder comprising:

a first pair of side rails comprising a first set of steps in-between the first pair of side rails and further comprising a first pair joining sections;

a second pair of side rails comprising a second set of steps in-between the second pair of side rails and further comprising a second pair joining sections, wherein the first pair of side rails and the second pair of side rails are rotatably attached with a pair of joining hinges;

a first guardrail with a pair of arms wherein the pair of arms of the first guardrail are rotatably attached to the first pair joining sections and second pair joining sections by the pair of joining hinges;

wherein the first pair joining sections comprises of a pair of first rotatable areas and the second pair joining section comprises of a pair of second rotatable areas, and the first pair joining sections further comprises of one or more locking points wherein one or more locking keys attached to the first guardrail engages one or more of the locking points to prevent the first guardrail from rotating freely, wherein one or more of the locking points are distributed on an edge of a first rotatable area to receive one of the locking keys of the first guardrail, wherein the ladder further comprises of a second guardrail attached to the first guardrail, wherein the second guardrail is rotatably attached to the pair of arms of the first guardrail, wherein the second guardrail comprises of a guardrail lock that prevents the second guardrail from freely rotating about the first guardrail and wherein the guardrail lock is slidably attached to the second guardrail, wherein the guardrail lock has a stopping edge to help prevent the guardrail lock from sliding freely on the second guardrail, wherein the guardrail lock overlaps both the corresponding arm of the first guardrail and a corresponding arm of the second guardrail, and wherein the guardrail lock is slidably adjustable so that the guardrail lock may be pushed over to not overlap the corresponding arm of the first guardrail so the guardrail lock does not engage the arm of the first guardrail.

18. The ladder of claim 17 wherein the guardrail lock is adjustable by having a slider that may be used to push the guardrail lock sideways.

19. The ladder of claim 18 wherein the ladder further comprises of a foldable stand attached to one of the steps of the first pair of side rails.

20. A ladder with a first guardrail locking system, said ladder comprising:

a first pair of side rails comprising a first set of steps in-between the first pair of side rails and further comprising a first pair joining sections;

a second pair of side rails comprising a second set of steps in-between the second pair of side rails and further comprising a second pair joining sections, wherein the first pair of side rails and the second pair of side rails are rotatably attached with a pair of joining hinges;

a first guardrail with a pair of arms wherein the pair of arms of the first guardrail are rotatably attached to the first pair joining sections and second pair joining sections by the pair of joining hinges;

wherein the first pair joining sections comprises of a pair of first rotatable areas and the second pair joining section comprises of a pair of second rotatable areas, and the first pair joining sections further comprises of one or more locking points wherein one or more locking keys attached to the first guardrail engages one or more of the locking points to prevent the first guardrail from rotating freely, wherein one or more of the locking points are distributed on an edge of a first rotatable area to receive one of the locking keys of the first guardrail, wherein the ladder further comprises of a second guardrail attached to the first guardrail, wherein a second guardrail is rotatably attached to a pair of arms of the first guardrail, wherein the second guardrail comprises of a guardrail lock that is slidably attached to one of a pair of arms of the second guardrail to prevent the second guardrail from freely rotating about the first guardrail, wherein the guardrail lock has a stopping edge to help prevent the guardrail lock from sliding freely on the second guardrail and wherein the guardrail lock overlaps both corresponding arm of the first guardrail and corresponding arm of the second guardrail, wherein the guardrail lock is slidably adjustable so that the guardrail lock may be pushed over to not overlap the corresponding arm of the first guardrail so the guardrail lock does not engage the arm of the first guardrail, Wherein the ladder further comprises of a foldable stand attached to one of the steps of the first pair of side rails.

* * * * *